US005267730A

United States Patent [19]

Keaggy

[11] Patent Number: 5,267,730

[45] Date of Patent: Dec. 7, 1993

[54] POOL CUE

[76] Inventor: David J. Keaggy, 2935 E. Clarendon, Phoenix, Ariz. 85016

[21] Appl. No.: 67,951

[22] Filed: May 27, 1993

[51] Int. Cl.[5] ..... A63D 15/08

[52] U.S. Cl. ..... 473/47; 473/48

[58] Field of Search ..... 273/68, 17, 70, 69, 273/80 D; 403/104, 110, 371, 290, 296; 280/823

[56] References Cited

U.S. PATENT DOCUMENTS

| | | | |
|---|---|---|---|
| 4,718,617 | 1/1988 | Desmond et al. | 273/68 |
| 4,858,926 | 8/1989 | Cabianca | 273/68 |
| 5,062,636 | 11/1991 | Rahn | 273/68 |

FOREIGN PATENT DOCUMENTS

| | | | |
|---|---|---|---|
| 539288 | 6/1922 | France | 273/68 |
| 2174611 | 11/1986 | United Kingdom | 273/68 |
| 2220862 | 1/1990 | United Kingdom | 273/68 |

*Primary Examiner*—Mark S. Graham
*Attorney, Agent, or Firm*—Warren F. B. Lindsley

[57] ABSTRACT

A cue for the game of billiards, pool and the like the length and weight of which may be selectively varied during use so the player can balance the cue to fit his or her needs and the length of the cue for the various strokes played.

6 Claims, 2 Drawing Sheets

23
22
21
15
4
16
19
17
24
5
27
26
28
18
25
17A
17'

17
30
17
34
17'

17
9
34
17'
24

31
32
33

35
36
37

17
17'
17"

17
38
24

18
40
38
39
24

POOL CUE

BACKGROUND OF THE INVENTION

This invention relates to improvements in cues used in playing the games of billiards, pool and the like. The word "cue" as used in this specification is intended to encompass cues for any use in any game Billard cues are traditionally made of wood either in one piece or of several pieces glued or laminated together. Recently cues have been made in pieces screwed together when assembled to form a cue of the length required When dismantled, the cue is easy to transport carry or store due to the shorter length of its individual pieces. Before use of these parts, the player has to reassemble the cue and during play if a longer length of the cue is required either an extension piece needs to be fitted to the assembly or a separate longer cue obtained. The opposite of course applies if a shorter cue is required.

DESCRIPTION OF THE PRIOR ART

The prior art discloses cues consisting of a number of telescopically related parts. However, none of these structures collapse or fold into an easily transportable configuration and extend or unfold into an operational cue configuration U.S. Pat. No. 4,718,617 discloses a cue for billiards, pool, and the like including telescopically engaged central and butt sections permitting infinite adjustment of cue length between two end positions and a lock for securing the central and butt sections by frictional engagement at any selected cue length. The frictional engagement is provided by a member on one of the butt and central sections to the cue to prevent relative axial movement of these sections. This member may comprise a collect disposed between two relatively movable abutments which are urged towards one another on relative rotation of the butt and central sections.

None of the prior art disclose the simplified cue structure set forth and claimed herein wherein the cue length may be adjustable, locked in a given position. selectively weighted as desired and when not in use broken down to form a carrier assembly.

SUMMARY OF THE INVENTION

As disclosed herein the claimed cue differs from existing prior art structures by providing a means for altering or adjusting its length according to the shot to be played without the need of fitting an extension piece to the cue.

This invention contemplates a cue, the length of which is telescopically adjustable between two extremes comprising at least two co-axial sections received one within the other and a locking device for holding them together in a fixed relative position.

It is therefore one object of this invention to provide a rigid cue of adjustable lengths.

Another object of this invention is to provide a rigid cue which can be quickly and easily adjusted for length so that the player can suit the length of the cue to each stroke he plays.

A further object of this invention is to provide an adjustable cue which can be selectively weighted at its base or mid way between its length to fit the need of the user.

Further objects and advantages of the invention will be pointed out with particularity in the claims annexed to and forming a part of this specification.

BRIEF DESCRIPTION OF THE DRAWINGS

The present invention may be more readily described with reference to the accompanying drawings, in which:

FIG. 9 is an exploded perspective view of circled area 9 of FIG. 8;

DESCRIPTION OF THE PREFERRED EMBODIMENT

Figures 1, 2, 3, 4, 5:
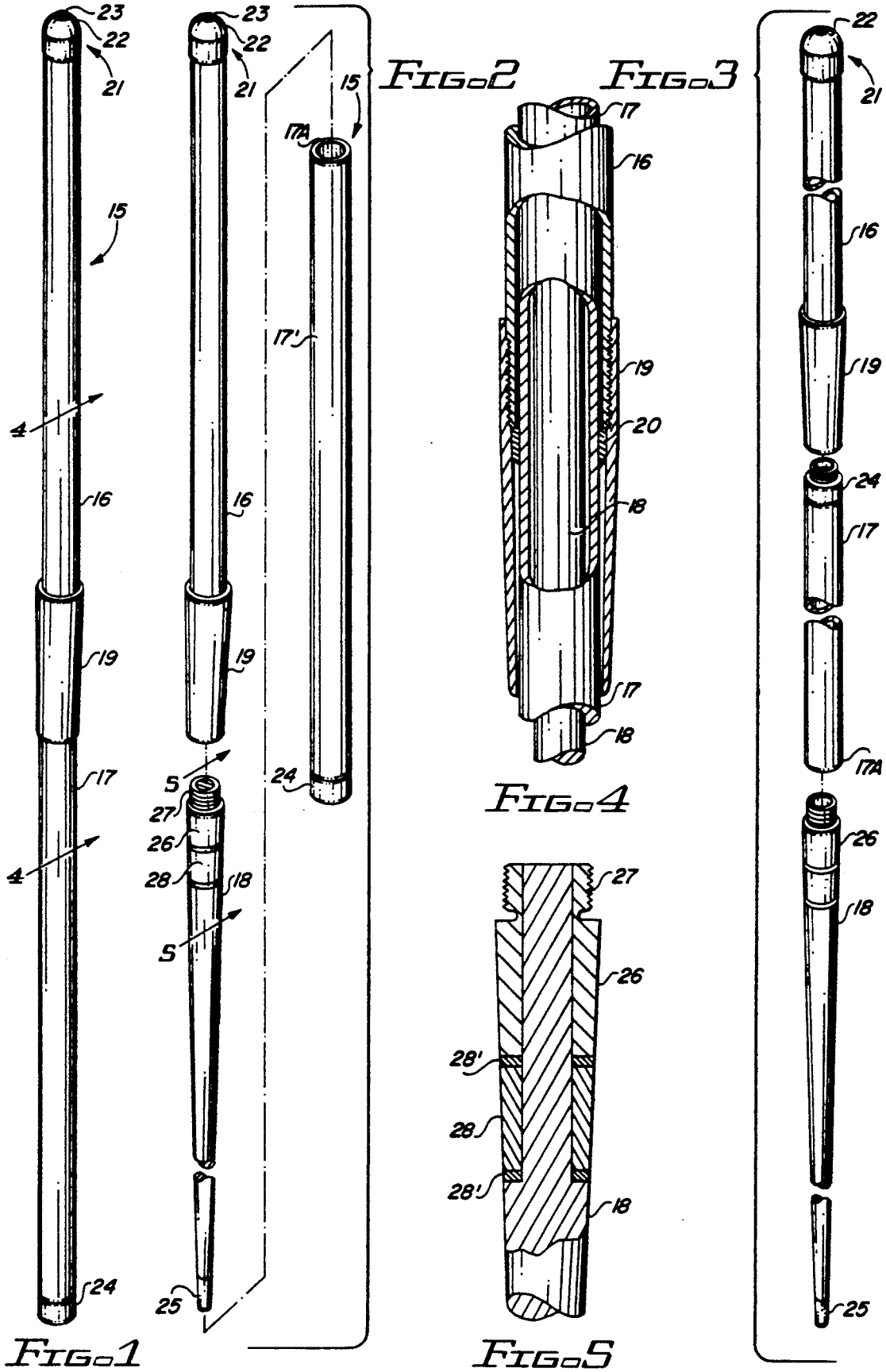
FIG. 1 is a perspective view of a cue in the storage mode for use in the game of billiards, pool and the like and embodying the invention.
FIG. 2 is an exploded perspective view of the disassembled parts of FIG. 1 prior to use.
FIG. 3 is an exploded perspective view of the disassembled parts in the use mode.
FIG. 4 is a cross sectional view partially broken away of FIG. 1 taken along the line 4—4.
FIG. 5 is a cross sectional view of FIG. 2 taken along the line 5—5.

Referring more particularly to the drawings by characters of reference, FIGS. 1 and 2 disclose a billiard or pool cue 15 comprising interconnected tubular base and central portions or parts 16 and 17 and a tip portion or part 18, the total length of which may be 58 to 72 inches in length In the storage mode, as shown in FIGS. 1 and 2, tip portion 18 is positioned within central part 17 with parts 16 and 17 held together by a locking collar 19 formed of Delrin or any other suitable material that is threadedly attached at one end to part 16 and frictionally engagable with part 17 at its other end by means of a locking ring 20, as shown in FIG. 4.

The base, handle or butt end of the cue, namely part 16 may comprise an extruded aluminum tubular member of approximately 1 inch outer diameter having a wall thickness of approximate 0.058 of an inch.

The base or handle end of part 16 is provided with a cap 21 threadedly attached thereto and comprises a rubber or resilient bumper 22 held thereto by an allen screw 23 The other end of part 17 of cue 15 is provided with a base 24 threadedly attached thereto Part 17 comprises an elongated extruded aluminum part having an outside diameter of ⅞ of an inch and a wall thickness of 0.058 inches. This part is provided with inside threads at each end with 24 threads per inch of tubing. Part 16 slips over the part 17 at close tolerances.

As noted from FIGS. 2 and 3 of the drawings, tip portion 18 of the cue comprises a tapered shaft having a ferrule and leather tip 25 at its pointed end and a threaded collar 26 secured such as by gluing to the tapered shaft 18 at its other end. Collar 26, as shown in FIG. 3, is internally threadedly attached to end 17A of part 17.

Thus, when assembled, as shown in FIG. 3, parts 16 and 17 are threadedly and frictionally engaged by locking collar 19 at one end of part 17 and part 17 is connected at its other end 17A to receive the threaded end 27 of tip portion 18. Tip portion 18 may comprise a decorative wood overlay 28, if so desired Inside of the locking collar 19 is a small split locking ring 20 which is set into a groove recessed in the inside periphery of collar 19. When collar 19 is advanced on the threads of the handle, namely part 16, the end of the handle presses against the split ring which then presses against a tapered ridge on the interior of the collar in a known manner. This action causes the split ring 20 to compress against the inner handle or part 17 and locks the outer handle, i. e., part 16 to the inner handle securely in any position within a 14 inch span. The locking collar requires approximately a half turn to loosen or tighten the outside handle or part to the inside handle or part.

Figures 6, 7, 8, 10, 11, 12, 13:
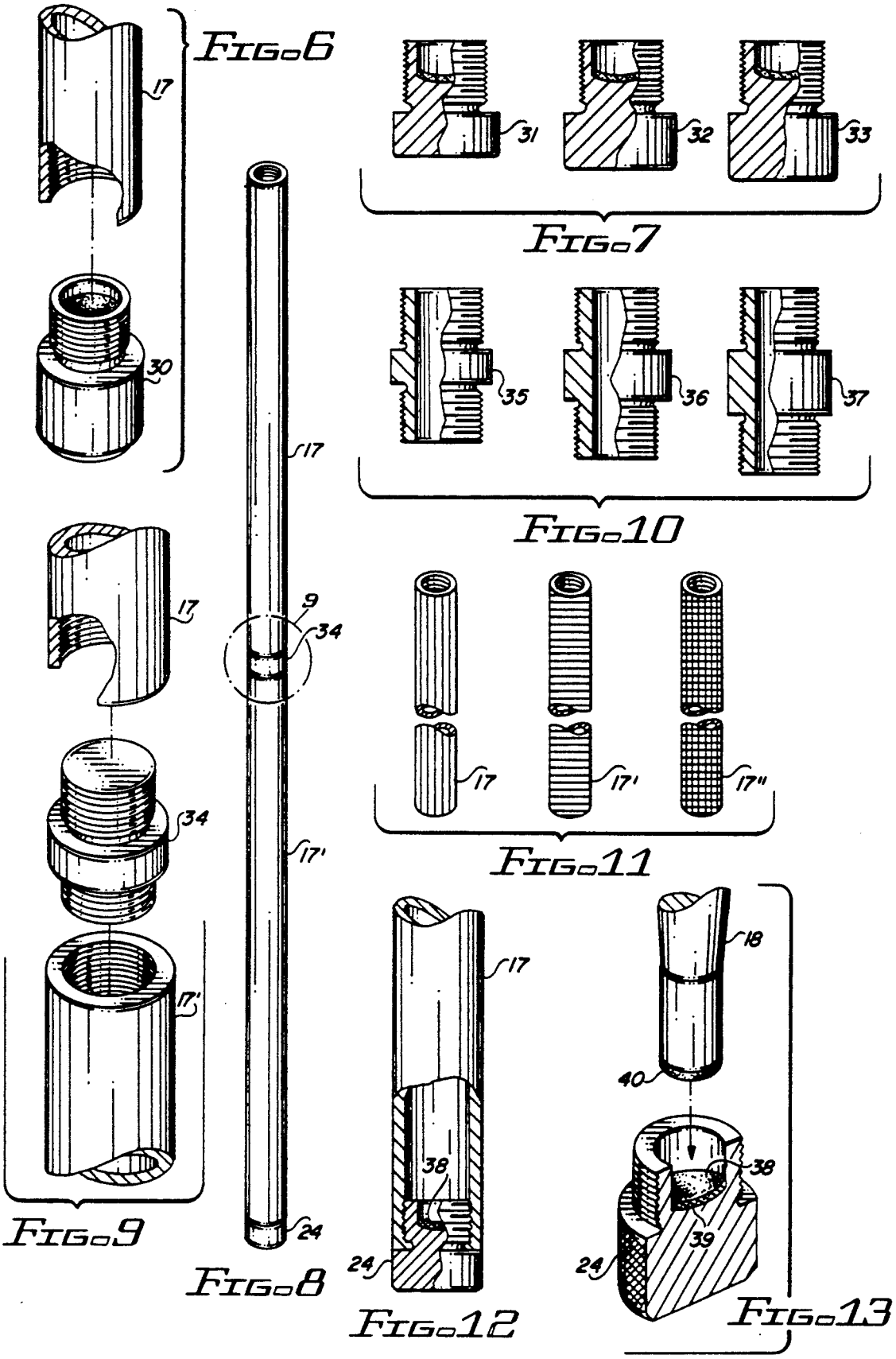
FIG. 6 is a perspective exploded view of the end cap and stuffer.
FIG. 7 is an assembly of weights used to replace the end cap of the cue.
FIG. 8 is a perspective view of two portions of the cue interconnected by a replaceable weight.
FIG. 10 is a cross sectional view of a plurality of weights varying in ½ ounce increments for use with the tubular members shown in FIG. 8.
FIG. 11 illustrates perspective views of different color tubes for assembly as illustrated in FIG. 9.
FIG. 12 is a perspective view partially broken away illustrating the scoffer for the tip of the cue.
FIG. 13 is a perspective view partially broken away illustrating carborundum granules for scuffing the leather tip of the cue tip.

As shown in FIGS. 6 and 7, base 24 on part 17 may be removed and replaced by one of a number of other bases of varying weights and sizes as shown in FIG. 7, to fit the needs of the user. FIG. 6 illustrates a base cap 30 with base caps 31, 32 and 33 of FIG. 7 being substituted therefor which provide a means for varying the overall Weight of the cue.

FIGS. 8 and 9 illustrate that part 17 may comprise two like parts 17 and 17′ interconnected by a means 34 for varying the weight of the cue by selectively inserting a given weight between juxtapositioned ends of parts 17 and 17′.

FIG. 10 illustrates a plurality of substitute weights 35, 36 and 37 that may replace weight 34 shown in FIG. 9. These weights may vary from each other in ½ ounce increments and may be formed of plastic or metal of various types such as, for example, brass.

FIG. 11 illustrates that parts 17 and 17′ may be formed of metallic tubular parts of varying colors such as red, blue and gold illustrated as parts 17, 17′ and 17″.

FIGS. 12 and 13 illustrate that base 24 may comprise an insert 38 presenting a surface embodying carborundum granules 39 for scuffing the leather tip 25 of the tip portion 18 of cue 15.

Although but a few embodiments of the invention have been illustrated and described, it will be apparent to those skilled in the art that various changes and modifications may be made therein without departing from the spirit of the invention or from the scope of the appended claims.

What is claimed is:

1. A cue the length of which is telescopically adjustable comprising:

elongated handle, central and tip sections, a first collar threadedly connected at one end to one end of the handle section and telescopically receiving at its other end one end of the central section, locking means mounted within said first collar for selectively frictionally engaging said one end of the central section upon a given rotation of said first collar when the central section is in a given telescopical relationship of the handle and central sections, base means for detachably mounting on the said one end of said central section for selectively varying the overall weight of the cue, and a second collar mounted on one end of the tip section for threadedly engaging the other end of the central section of the cue.

2. The cue set forth in claim 1 wherein:

said central section comprises two cylindrical parts interconnected by a plug each end of which threadedly engages a different end of said cylindrical parts, whereby replacement of said plug with a similar plug of a different weight makes it possible to vary the weight of the cue substantially midway of its length 3. The cue set forth in claim 1 wherein:

said base means comprises a hollow interior at least a part of which is covered with epoxy material containing granules for scuffing the tip end of the tip section.

4. The cue set forth in claim 3 wherein:

said granules comprise carborundum.

5. The cue set forth in claim 1 wherein:

said second collar comprises an overlay for decorative purposes.

6. The cue set forth in claim 2 wherein:

one or more of said cylindrical parts may be treated to present a given color appearance.

* * * * *